United States Patent [19]

Arroyo-Garcia

[11] 3,975,139

[45] Aug. 17, 1976

[54] SYSTEM FOR FUEL BURNING

[76] Inventor: Carmen Santiago Arroyo-Garcia, Nuevo Leon, Monterrey, Mexico

[22] Filed: Oct. 29, 1974

[21] Appl. No.: 518,605

[52] U.S. Cl. ..... 431/208; 431/117

[51] Int. Cl.[2] ..... F23D 11/44

[58] Field of Search ..... 431/11, 207, 208, 161, 431/162, 213, 117, 118

[56] References Cited

UNITED STATES PATENTS

| | | | |
|---|---|---|---|
| 2,896,701 | 7/1959 | Linde et al. | 431/207 |
| 3,199,505 | 8/1965 | Lloyd | 431/208 |
| 3,326,262 | 1/1967 | Weller et al. | 431/208 X |

*Primary Examiner*—Edward G. Favors
*Attorney, Agent, or Firm*—Laurence R. Brown

[57] ABSTRACT

The present invention refers to an improved system for fuel burning, whose combination of the means which make it up permit a combustion lacking a high percentage of contaminants, a circumstance which is attained as the consequence of a preheating and overheatng process to which the fuel is subjected before it is burned, gaining this through the combination of a system of air rationing, a heating reactor, a burner provided with a double receptive entry and a drainage system for discharge fuel which is combined with a secondary fuel conducting pipe which taking advantage of the heat transmitted by the discharge fuel along the drainage walls, subsequently joins the main pipe through which it communicates with the heating chamber.

5 Claims, 2 Drawing Figures

SYSTEM FOR FUEL BURNING

The present invention refers to an improved system for fuel burning, whose combination of the means which make it up permit a combustion lacking a high percentage of contaminants, a circumstance which is attained as the consequence of a preheating and overheating process to which the fuel is subjected before it is burned, gaining this through the combination of a system of air rationing, a heating reactor, a burner provided with a double receptive entry and a drainage system for discharge fuel which is combined with a secondary fuel conducting pipe which taking advantage of the heat transmitted by the discharge fuel along the drainage walls, subsequently joins the main pipe through which it communicates with the heating chamber.

The purpose of the invention is to suppress the deficiencies which to data are present in the known combustion system, which by its structure and combination of means give out, once combustion is carried out, fumes at times relatively contaminant and other times fumes which are highly contaminant.

On the other hand, from tests carried out, it is possible to assert that through the use of the present invention besides getting a combustion with a very low contamination index, greater efficiency is attained in the exploitation of the energy being used and a considerable savings of energy when taking advantage of the heat given out by the discharge fuel to heat the usable fuel which moves through the secondary pipe on its way to the preheating chamber.

Another advantage of the present invention is that by the combination of its means in the system proposed in the present application, the use of carbon dioxide ($CO_2$) is eliminated which is commonly used in the combustion industry to generate mass, it is obvious that use of such compound also requires a $CO_2$ producing system which means a greater investment in the combustion system in the known process and at the same time much more expensive maintenance than that required by the combustion system claimed by the present application.

From the various tests done it is possible to assert that another advantage which the present invention carries is that of providing at the moment of combustion a flame with a wide range of combustion, that is to say a reducing flame can be produced as well as a neuter or oxydizing flame, while in the combustion system known to date, the flame has a noticeably reduced spectrum, since some are definetely reducing or are neuter or notably oxydizing, without varying their flame quality with the ease with which can be varied the one gotten through the means of the combustion system covered in this application.

The characteristic details of the present invention are clearly shown in the following description and in the drawings accompanying it as an illustration of it and using the same reference marks to point out the same parts in the figures shown.

Figure 1:
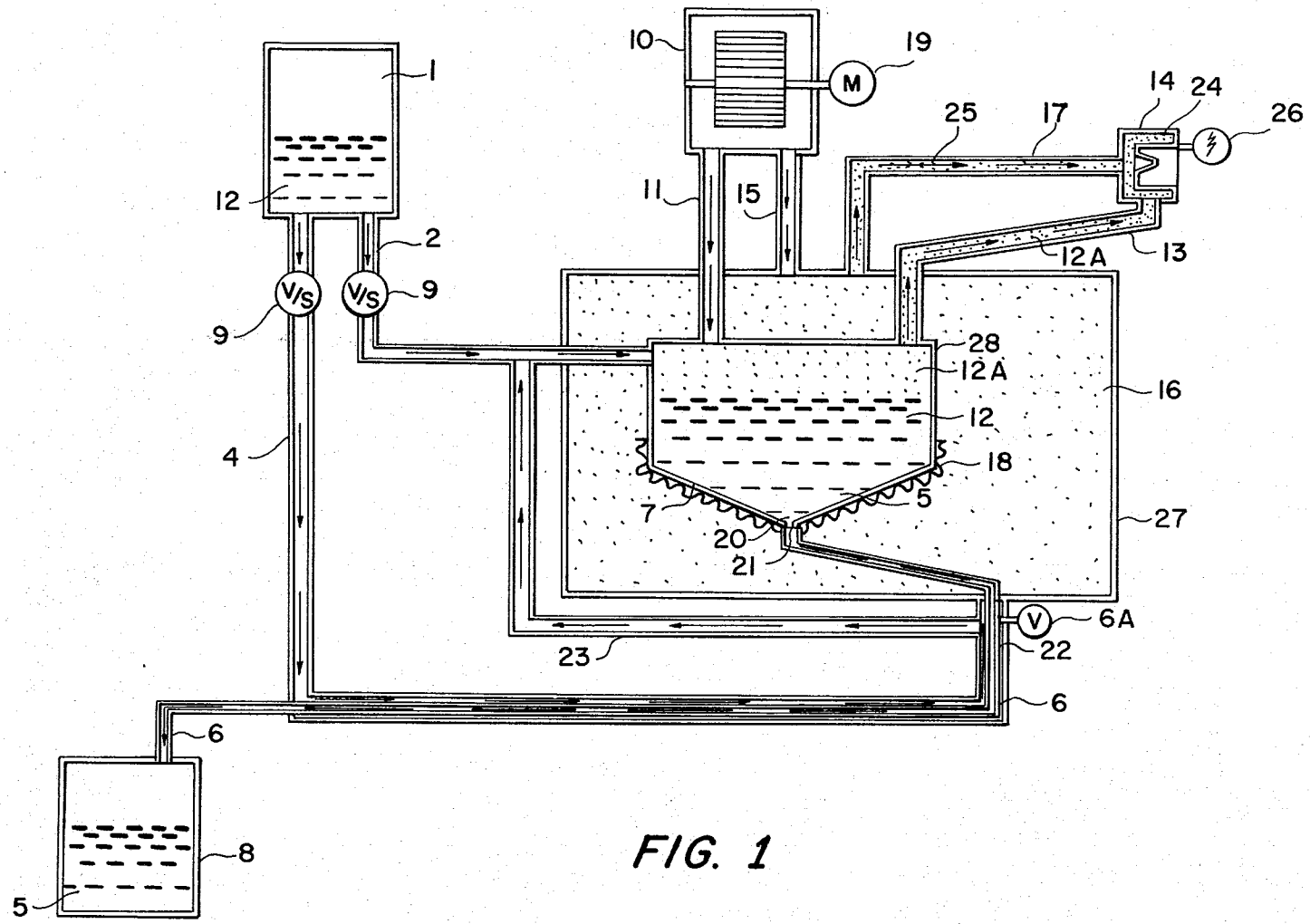
FIG. 1 shows a schematic diagram of combustion system.
Figure 2:
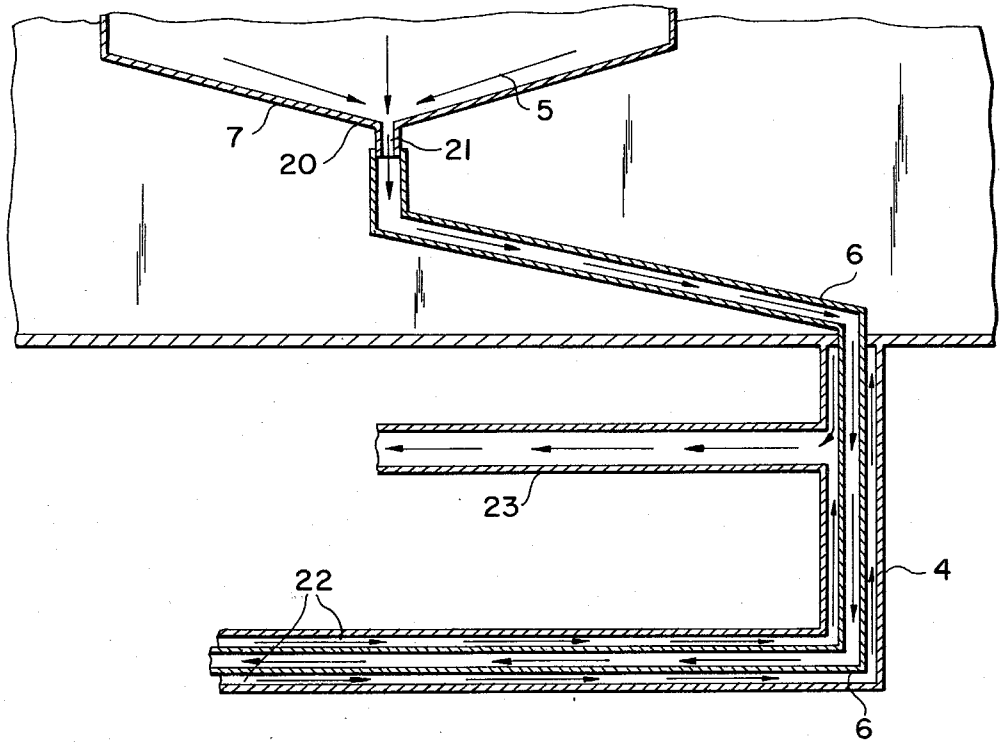
FIG. 2 shows in detail a longitudinal cross section of the drainage which carries discharge fuel in one direction and the secondary pipe which carries the usable fuel in opposite direction.

The present system is characterized by the combination of a tank 1 in which the fuel is placed 12, this tank 1 which may be of any type, has a primary pipe 2 which connects it directly with the inner heating chamber 3 thus giving passage of the fuel directly from the tank 1 to the inner heating chamber 3. On the other hand, the tank 1 has a secondary pipe 4 through which the fuel is also carried to the inner heating chamber 3, except that through the use of the secondary pipe 4 it is possible to take advantage of the calorific energy radiated by the discharge fuel 5 which is driven through the drain 6 from the hopper 7 of the inner chamber 3 towards a storage tank.

So that the fuel exit 12 can be regulated in a synchronized manner towards the inner chamber 3 the primary pipe 2 as well as the secondary pipe 4 may be provided with valves 9 which may be of any type but nevertheless those valves most advantageous to use are those which driven by electronic means start the phase of passage of the fuel 12 at it be commanded by appropriate electronic or manual means.

This combustion system is also characterized by the combination of a rationing system 10 which may be of any type, through which atmospheric air is injected through a primary duct 11 to the inner chamber 3 so that as the fuel 12 is heated it oxigenates or vaporizes, such oxigenation during the heating process allowing the suspension substances contained in the fuel 12 to be precipitated towards the hopper 7 and are from there carried by the drainage 5 through the drain 6 towards the storage tank 8. On the other hand, oxigenating the fuel 12 the mass 12 A is obtained which subsequently and through the primary pipe 13 will reach the burner 14.

The proportionate chamber 10 has a secondary pipe 15 through which atmospheric air is injected to the outer chamber 16, said air upon becoming in contact with the calorific energy radiated by the inner chamber 3 is also heated and in such a state it goes out through the secondary conductor 17 towards the burner 14.

This combustion system has a reactor characterized by the combination of a receptacle termed an inner heater chamber 28 which is placed within the reactor, making up in its interior the inner chamber 3, the reactor body 27 forms an outer chamber 16 said reactor being communicated by means of primary pipes 2 and secondary pipes 4 to the tank 1 by primary ducts 11 and secondary ducts 15 to the proportioning chamber 10, by primary conductors 13 and secondary conductors 17 to the burner 14, and by the drainage 6 to the storage tank 8.

To heat the fuel 12 the receptacle 28 is provided with a heater 18 of any type, although it has been found to be preferable to use an electric induction heater, and through said heater 18 the temperature at which the fuel 12 should be heated inside the inner chamber 3 is regulated.

To effect the combustion in this system, various temperatures have been tested, and even when this system can function with a certain degree of flexibility, it has been found that a temperature of 250°C is preferred to heat the fuel 12. Such temperature produces the optimum reaction of the combustibles known to date preferably diesel, nevertheless it is obvious that said temperature may vary depending on the quality of diesel fuel being used as combustible, as well as the type of combustible used, taking into account that such variation might follow a change in atmospheric pressure and relative humidity of the environment at a given time.

The proportioning chamber system 10 may be activated by any motor element 19 which impels the dispenser 10 and its start should coincide with the start of the system in general, it has been found as preferable that the motor element 19 have a starter which in turn may be regulated by appropriate electronic or manual means.

The hopper 7 which is an integral part of the receptacle 28 has in its base 20 an outlet 21 to which the drainage is connected 6; covering and forming a sleeve inside the secondary pipe 4 in such a way that between the secondary pipe 4 and the drain 6, exists a cavity 22 through which fuel 12 travels in opposite direction to the discharge 5. Such mechanics make it so that the calorific energy given out by the discharge 5 be transmitted towards the fuel 12 which is found traveling through the cavity 22 so that as the fuel 12 passes towards the removal pipe 23 which carries it to the primary pipe 2, the fuel 12 is already relatively hot, which logically means a savings in calorific energy when the fuel 12 is heated in the inner chamber 3.

It is wise to point out that the discharge 5 once deposited in the storage tank 8 may be, through any procedure, be regenerated to be used again as fuel 12.

The burner 14 may be of any type, except that in the present system it has been found as preferable a burner which may accept in the reception chamber 24 both the mass 12 A which comes through the primary conductor 13 as well as hot air 25 coming from the outer chamber 16 through the secondary conductor 17 since upon the combustion of the mass 12 A with the hot air 25 the chemical reaction which produces the combustible gas takes place.

The system object of the present invention shall also have in combination with an ignition system 26 which would consist of a pilot, a spark plug or any other flame spark or heat producing mechanism, which would be controlled by any means, it has been found that it is preferable to have a system through a photocell or any appropiate detection system, it may start the ignition system simultaneously with the starter of the motor element 19 of the rationing system 10 and the valve 9 functioning as well as the outlet valve 6 A which controls the drainage flow 6.

It is not, of course, the intent of the inventor to limit the extent of his invention to the order or the placing of the various elements, mechanisms or related systems which make up his invention, but to claim for himself any combustion system which based on the principles described may produce the same industrial results.

What I claim is:

1. An improved fuel burning system characterized by the combination of a fuel tank, a fuel chamber containing both liquid and vaporized fuel, means heating the liquid fuel in said chamber, a burner, at least one pipe transporting liquid fuel from said tank to said chamber, means vaporizing fuel heated in said chamber, means transporting heated vaporized fuel from said chamber to said burner for combustion, means removing residual liquid fuel from said chamber whenever said burner is ignited wherein two pipes transport fuel from said fuel tank to said chamber and means heats fuel in one pipe from the residual liquid fuel flowing from said chamber.

2. A system as defined in claim 1 including an air source and wherein said means vaporizing liquid fuel comprises means contacting said heated fuel in said chamber with said air to vaporize the fuel.

3. A system as defined in claim 1 including an air source, an outer chamber surrounding said inner chamber, connected for heating air from said source, and means conveying heated air from said outer chamber to said burner to mix thereat with said heated vaporized fuel.

4. A system as defined in claim 1 including pump means providing air to maintain pressure in said chamber above atmospheric pressure.

5. A system as defined in claim 1 including an ignition system for said burner and means synchronizing the feeding of liquid fuel, air and removal of residual fuel with ignition of said burner.

* * * * *